US010011454B2

(12) United States Patent
Takeo

(10) Patent No.: US 10,011,454 B2
(45) Date of Patent: Jul. 3, 2018

(54) SHEET PROCESSING DEVICE, METHOD FOR CONTROLLING SHEET PROCESSING DEVICE, PROGRAM, AND STORAGE MEDIUM FOR EXECUTING STAPLING PROCESSING IN RESPONSE TO AN EXECUTION KEY PRESSED BY A USER

(71) Applicant: CANON KABUSHIKI KAISHA, Tokyo (JP)

(72) Inventor: Akinori Takeo, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 262 days.

(21) Appl. No.: 14/968,683

(22) Filed: Dec. 14, 2015

(65) Prior Publication Data

US 2016/0185559 A1 Jun. 30, 2016

(30) Foreign Application Priority Data

Dec. 25, 2014 (JP) ..... 2014-263176

(51) Int. Cl.
*B65H 37/04* (2006.01)
*G03G 15/00* (2006.01)

(52) U.S. Cl.
CPC ..... *B65H 37/04* (2013.01); *G03G 15/502* (2013.01); *B65H 2408/121* (2013.01); *B65H 2408/122* (2013.01); *B65H 2553/41* (2013.01); *B65H 2557/354* (2013.01); *B65H 2557/64* (2013.01); *B65H 2801/06* (2013.01); *G03G 15/6544* (2013.01); *G03G 2215/00721* (2013.01)

(58) Field of Classification Search
CPC ..... B65H 37/04; B65H 2408/121; B65H 2553/41; B65H 2557/354; B65H 2557/64; B65H 2801/06; G03G 15/502; G03G 15/6544; G03G 2215/00721; G65H 2408/122
See application file for complete search history.

(56) References Cited

U.S. PATENT DOCUMENTS 4,801,133 A * 1/1989 Ishiguro ..... B42C 1/125 227/78
6,850,719 B2 * 2/2005 Nagaya ..... B65H 43/00 399/16
2010/0321706 A1 * 12/2010 Mori ..... G03G 15/6508 358/1.5

(Continued)

FOREIGN PATENT DOCUMENTS

JP 2011003005 A * 1/2011 ..... G03G 15/6508
JP 2011003005 A 1/2011

(Continued)

*Primary Examiner* — Patrick H Mackey
(74) *Attorney, Agent, or Firm* — Canon U.S.A., Inc. IP Divison

(57) ABSTRACT

A sheet processing device includes a stapler that executes stapling processing, a sheet detection sensor that detects a sheet as a processing target, and an execution button that receives an instruction to execute the stapling processing from a user. The sheet processing device lights up the execution button when the sheet detection sensor detects the sheet, and causes the execution button to blink when the execution button is pressed or a predetermined time period has elapsed.

12 Claims, 8 Drawing Sheets

(56) References Cited

U.S. PATENT DOCUMENTS

| | | | | |
|---|---|---|---|---|
| 2015/0014384 | A1* | 1/2015 | Obuchi | B27F 7/17 227/99 |
| 2015/0021374 | A1* | 1/2015 | Kubo | B65H 37/04 227/39 |
| 2015/0021844 | A1* | 1/2015 | Kubo | B31F 5/001 270/1.01 |
| 2016/0185560 | A1* | 6/2016 | Mutsuno | B65H 43/00 270/1.01 |
| 2016/0185563 | A1* | 6/2016 | Mutsuno | G03G 15/6582 270/58.02 |

FOREIGN PATENT DOCUMENTS

| | | | | |
|---|---|---|---|---|
| JP | 2014162590 A | * | 9/2014 | G03G 15/5004 |
| JP | 2014162590 A | | 9/2014 | |

* cited by examiner

| |
|---|
| FIG. 5A |
| FIG. 5B |

SHEET PROCESSING DEVICE, METHOD FOR CONTROLLING SHEET PROCESSING DEVICE, PROGRAM, AND STORAGE MEDIUM FOR EXECUTING STAPLING PROCESSING IN RESPONSE TO AN EXECUTION KEY PRESSED BY A USER

BACKGROUND OF THE INVENTION

Field of the Invention

The present invention relates to a sheet processing device that executes processing on sheets.

Description of the Related Art

Conventional sheet processing devices that execute processing on sheets have been known. As specific examples of the processing on the sheets, processing (stapling) for binding a plurality of sheets by using a staple, non-staple crimp processing (stapleless stapling) for binding the plurality of sheets without using the staple but by crimping the plurality of sheets together, and processing for punching a punch hole in the sheets are known. These processings are hereinafter referred to as "sheet processing".

An example of the sheet processing device includes a device that is used being connected to a printing apparatus that prints an image on a sheet. When the sheet processing device and the printing apparatus are connected to each other, the sheet processing device is disposed on a downstream side of the printing apparatus in a conveyance direction of the sheet. The sheet processing device receives the sheets bearing the printed images from the printing apparatus and executes the sheet processing on the sheets.

Further, sheet processing devices have been known that can not only execute the sheet processing involving image printing by the printing apparatus but can also execute the sheet processing not involving the image printing by the printing apparatus. Japanese Patent Application Laid-Open No. 2014-162590 and Japanese Patent Application Laid-Open No. 2011-003005 discuss printing systems having a function of executing the sheet processing involving the image printing by the printing apparatus and a function of executing the sheet processing not involving the image printing by the printing apparatus.

Japanese Patent Application Laid-Open No. 2014-162590 discusses a technique in which the sheet processing is executed when a user performs a predetermined operation (for example, pressing of a button) after the sheets are set. On the other hand, Japanese Patent Application Laid-Open No. 2011-003005 discusses a technique in which the sheet processing is executed not only in response to the predetermined user operation after the sheets are set but is also executed when a predetermined time period (for example, 10 seconds) elapses after the sheets have been set.

However, the technique discussed in 2011-003005 provides no means that in advance notifies the execution of the sheet processing in a case where the sheet processing is executed in response to the elapse of the predetermined time period after the sheets have been set. More specifically, when 10 seconds are set as the predetermined time period in the printing system discussed in Japanese Patent Application Laid-Open No. 2011-003005, for example, conveyance of the sheet is started immediately after 10 seconds have elapsed. Thus, the user is not notified of the execution of the sheet processing before the conveyance of the sheet is started.

When the end portion is inserted into an insertion port, the sheet processing is executed on an end portion of the sheets immediately after the predetermined time period has elapsed according to Japanese Patent Application Laid-Open No. 2014-162590. The user friendliness is low in such a configuration because when the sheet processing is executed while fine adjustment of the position of the set sheets by the user is in progress, the stapling processing is executed at an unintended position.

Furthermore, the configuration discussed in Japanese Patent Application Laid-Open No. 2011-003005, which involves both executing the sheet processing in response to the user operation and executing the sheet processing in response to the elapse of the predetermined time period, has a problem in that even if the notification of the execution is made, when the notification indicating the execution of the sheet processing is made in only one of the two cases, it is difficult for the user to recognize the notification.

SUMMARY OF THE INVENTION

A sheet processing device according to an aspect of the present invention includes a sheet processing unit configured to execute sheet processing, a detection unit configured to detect a sheet as a processing target, a control unit configured to cause the sheet processing unit to execute the sheet processing when a predetermined condition is satisfied after the detection unit has detected the sheet, and a notification unit configured to make a first notification to a user when the detection unit detects the sheet as the processing target and make a second notification to the user when the predetermined condition is satisfied.

Further features of the present invention will become apparent from the following description of exemplary embodiments with reference to the attached drawings.

DESCRIPTION OF THE EMBODIMENTS

Exemplary embodiments of the present invention are described in detail below with reference to the drawings. The exemplary embodiments described below do not limit the present invention to the claims, and the solution provided by the present invention does not necessarily require all combinations of features described in the exemplary embodiments.

Figure 1:
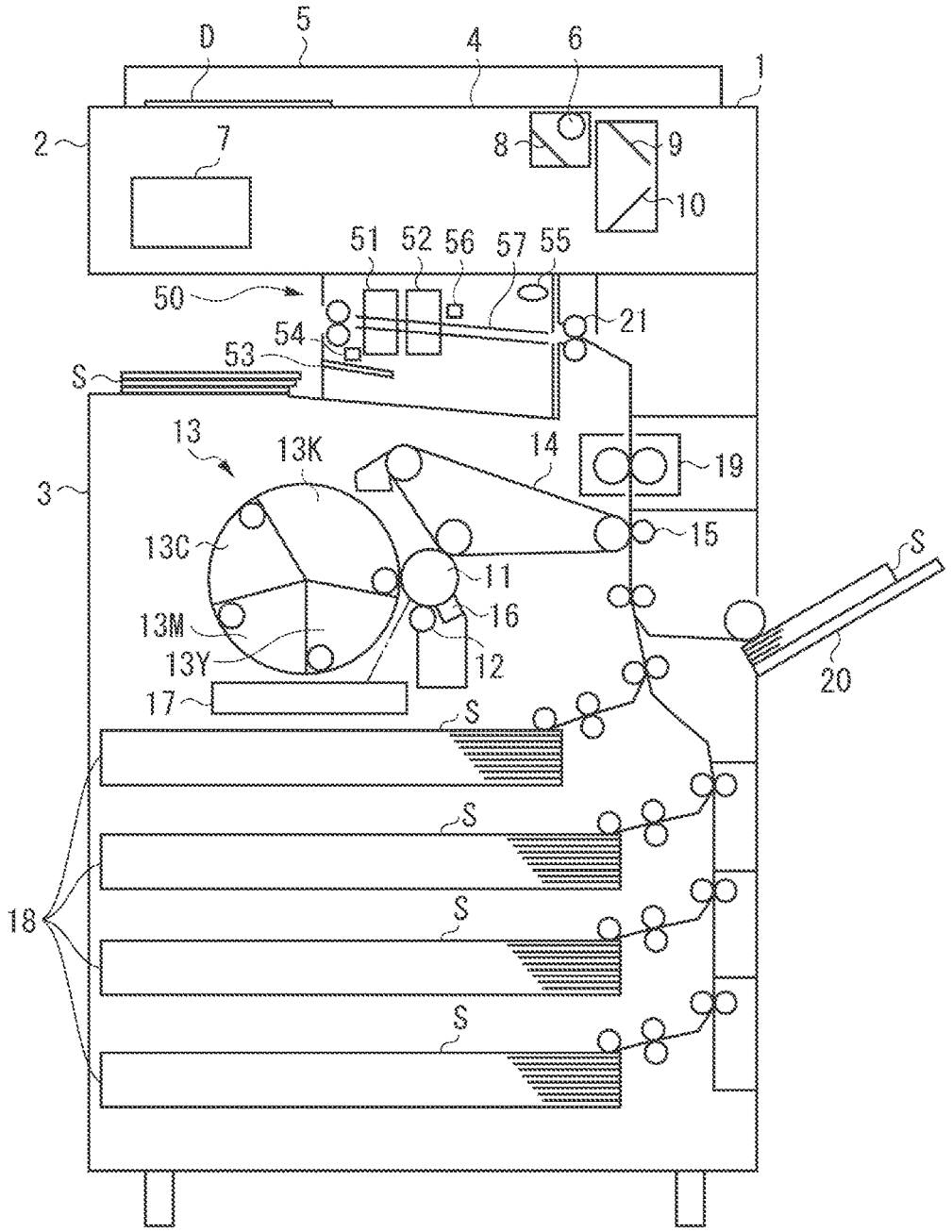
FIG. 1 is a cross-sectional view of a printing system according to a first exemplary embodiment of the present invention.

A first exemplary embodiment is described below. FIG. 1 is a cross-sectional view of an overall printing system including a sheet processing device 50 to which the present invention is applied, and a printing apparatus 1 to which the sheet processing device 50 is connected. Here, the sheet processing device 50 is provided separately from the printing apparatus 1. Alternatively, an overall configuration including the sheet processing device 50 may be referred to as the printing apparatus, or an overall configuration including the printing apparatus 1 may be referred to as the sheet processing device.

The printing apparatus 1 includes a scanner 2 that reads an image on a document and generates image data and a printer 3 that forms an image on a sheet, as two major components. A platen 4 including a transparent glass plate, is provided at an upper portion of the scanner 2. A document D, set at a predetermined position of the platen 4 with a reading target image facing downward, is pressed and fixed by a document pressing plate 5. A lamp 6 that radiates light onto the document D and an optical system member including reflection mirrors 8, 9, and 10 that guide reflected light to an image processing unit 7, are disposed below the platen 4. The document D is scanned when the lamp 6 and the reflection mirrors 8, 9, and 10 are moved at predetermined speed.

The printer 3 includes a photosensitive drum 11, a primary charging roller 12, a rotary developing unit 13, an intermediate transfer belt 14, a transfer roller 15, a cleaner 16, and the like. An electrostatic latent image is formed on a surface of the photosensitive drum 11 by a laser beam radiated from a laser unit 17 based on the image data generated by reading the image on the document D. The primary charging roller 12 uniformly charges the surface of the photosensitive drum 11 before the laser beam is radiated.

The rotary developing unit 13 forms a toner image by attaching toner of each of colors magenta (M), cyan (C), yellow (Y), and black (K) to the electrostatic latent image formed on the surface of the photosensitive drum 11. The toner image developed on the surface of the photosensitive drum 11 is transferred onto the intermediate transfer belt 14, and is then transferred onto a sheet S by the transfer roller 15. The cleaner 16 removes toner remaining on the photosensitive drum 11 after the toner image has been transferred.

The rotary developing unit 13 employing rotary development method, includes developers 13K, 13Y, 13M, and 13C and can be rotated by a motor (not illustrated). When a monochrome toner image is formed on the photosensitive drum 11, the developing is performed with the developer 13K which is rotationally moved to a developing position adjacent to the photosensitive drum 11. When a full color toner image is formed, the rotary developing unit 13 is rotated so that the developers 13K, 13Y, 13M, and 13C are each disposed at the developing position, and the developing is sequentially performed for each color.

The sheet S, onto which the toner image on the intermediate transfer belt 14 is transferred, is fed to a transfer position from a cassette 18 or a manual sheet feeding tray 20. A fixing device 19 that fixes the toner image on the sheet S being conveyed is disposed on a downstream side of the transfer roller 15 in a conveyance direction. The sheet S with the fixed toner image is discharged to the sheet processing device 50 on the downstream side in the conveyance direction from the printing apparatus 1 by a discharge roller pair 21.

The sheet processing device 50 is connected to a discharge position of the printing apparatus 1 and can communicate with the printing apparatus 1 through a signal line (not illustrated). The sheet processing device 50 communicates with the printing apparatus 1 to operate in cooperation with the printing apparatus 1. The sheet processing device 50 includes staplers 51 and 52. The stapler 51 binds a plurality of the sheets S discharged by the discharge roller pair 21 by using a staple. The stapler 52 binds the plurality of sheets S without using the staple. As described below with reference to FIG. 3, the stapler 51 is movable and thus can execute binding processing at a plurality of portions, whereas the stapler 52 is fixed at a single portion. Alternatively, the stapler 52 may also be configured to be movable. A puncher that punches a hole in the sheet S and the like may be provided in addition to the staplers 51 and 52.

The sheet processing device 50 includes a sheet detection sensor 56 that detects the sheet S and a sheet alignment unit 57 that aligns the sheets S. The sheet processing device 50 detects the sheet S conveyed to the sheet alignment unit 57 with the sheet detection sensor 56, and executes binding processing with the stapler 51 (stapling) or binding processing with the stapler 52 (stapleless stapling) in accordance with an instruction form a user.

The sheet processing device 50 has an offline staple function of executing the binding processing on the sheet S directly set to the sheet processing device 50 by the user instead of the sheets S supplied from the cassette 18 or the manual sheet feeding tray 20. When the offline staple function is executed, the binding processing with the stapler 51 using the staple is executed. The user that utilizes the offline staple function inserts the sheet S as a processing target to a sheet insertion port 53. The sheet insertion port 53 has a form of a slit into which the sheet S is inserted by the user. The sheet detection sensor 54 detects the sheet S inserted to the sheet insertion port 53.

When the sheet detection sensor 54 detects the sheet S, the sheet processing device 50 transitions to an offline mode (offline mode is turned ON). When the user presses an execution button 55 while the offline mode is ON, the stapling processing with the stapler 51 is executed. When the sheet detection sensor 54 continuously detects the sheets S for a predetermined period of time, the stapling processing is automatically executed even when the execution button 55 is not pressed.

While the offline mode is ON, printing by the printing apparatus 1 is restricted, and thus no sheet S is conveyed from the printing apparatus 1 to the sheet processing device 50. The execution button 55 includes a light emitting unit (light emitting diode (LED)) that can be lit and can blink to notify the user of a state of the sheet processing device 50. Lighting-up of the light emitting unit indicates that the execution button 55 can be pressed (that is, sheet processing can be executed). The light emitting unit that is blinking indicates that the sheet processing will be soon executed. The state may be notified not only by the LED but may also be notified by displaying a message or outputting a sound.

Figure 2A:
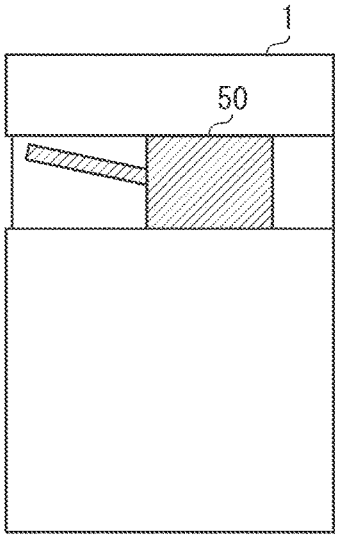
FIGS. 2A and 2B are schematic diagrams illustrating example connection modes between a printing apparatus and a sheet processing device according to the first exemplary embodiment of the present invention.
Figure 2B:
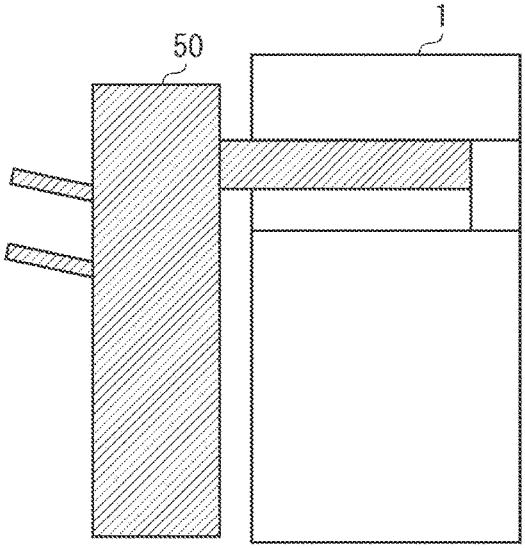

FIG. 2 is a schematic diagram illustrating example connection modes between the sheet processing device 50 and the printing apparatus 1. FIG. 2A illustrates an example where the sheet processing device 50 is disposed within the printing apparatus 1. FIG. 2B illustrates an example where the sheet processing device 50 is disposed outside the printing apparatus 1. In both connection modes, the sheet processing device 50 can execute the stapling processing on the sheets S discharged by the discharge roller pair 21 of the printing apparatus 1, and the stapling processing on the sheets S directly set to the sheet processing device 50 by the user.

Figure 3:
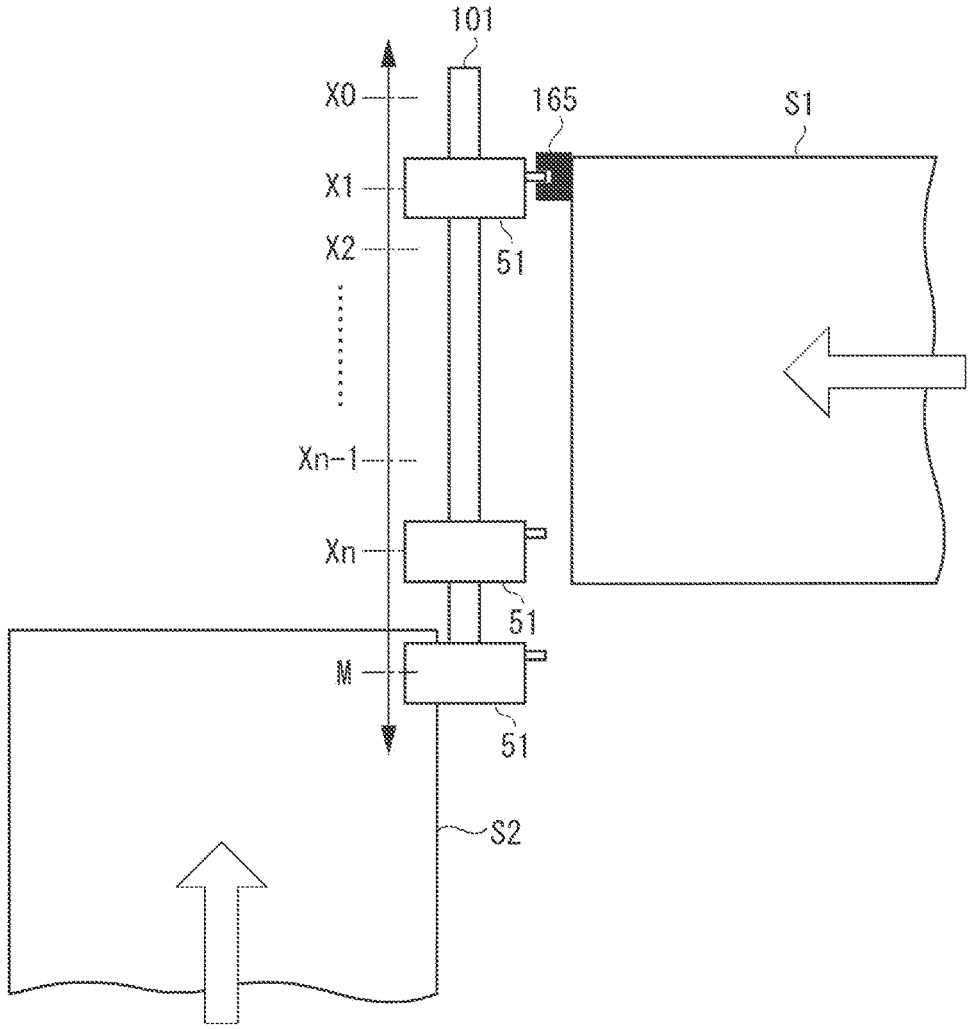
FIG. 3 is a diagram illustrating a configuration of a stapler of the sheet processing device according to the first exemplary embodiment of the present invention.

FIG. 3 is a diagram illustrating a configuration of the stapler 51 of the sheet processing device 50. FIG. 3 is a cross-sectional view of the sheet processing device 50 as viewed from the above. A lower side in FIG. 3 corresponds to a front side (near side) of the printing apparatus 1 illustrated in FIG. 1. The stapler 51 is movable along a movement path 101 along directions indicated by arrows. The stapler 51 has two functions. A first function of the stapler 51 is executing the stapling processing on sheets S1 discharged from the printing apparatus 1. A second function of the stapler 51 is executing the stapling processing on sheets S2 inserted to the sheet insertion port 53.

The stapling processing on the sheets S1 needs to be executed at a staple position set by the user. Thus, the stapler 51 is driven by a stapler moving motor 164 (FIG. 4) to move along the movement path 101, so that the stapling processing can be executed at any of positions X1, X2, . . . Xn−1, and Xn. Although not illustrated in the figure, the stapler 51 is also movable in an upward and downward direction (vertical direction).

On the other hand, the sheets S2 are stapled by the staple processing on the sheets S2 inserted to the sheet insertion port 53 on the front surface (near side) of the sheet processing device 50. Thus, to execute the stapling processing on the sheets S2, the stapler 51 is moved to a position M on the front side (near side) of the sheet processing device 50.

The stapler 51, if disposed on the conveyance path of the sheet S1, interferers with the sheet S1 being conveyed. Thus, the stapler 51 is retracted to a position X0 so as not to interfere with the sheet S1 being conveyed when the stapling processing with the stapler 51 is not executed.

Figure 4:
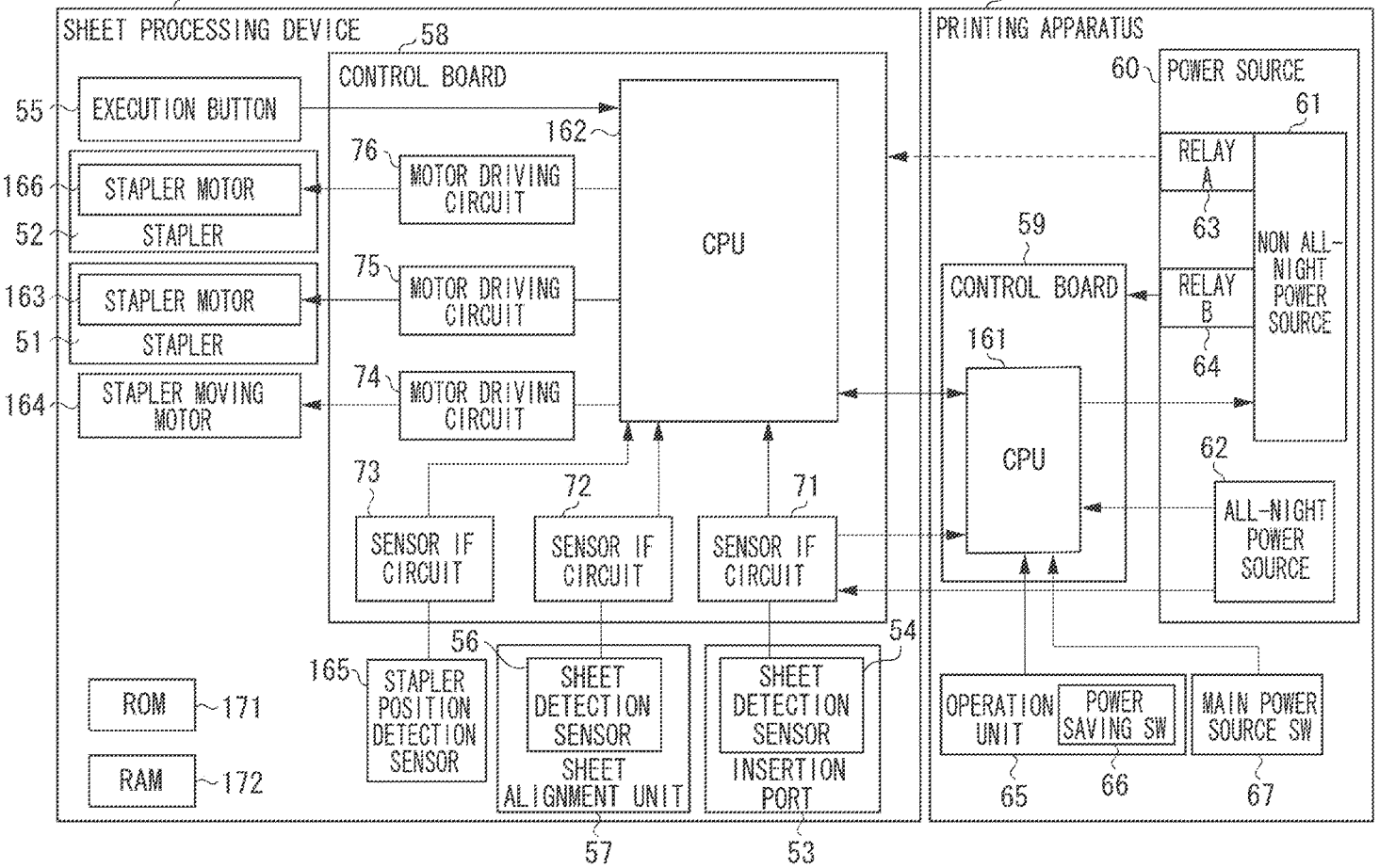
FIG. 4 is a diagram illustrating a hardware configuration of a control system of the printing apparatus and the sheet processing device according to the first exemplary embodiment of the present invention.

Next, a configuration of a control system of the printing apparatus 1 and the sheet processing device 50 will be described. FIG. 4 is a diagram illustrating a hardware configuration of the control system of the printing apparatus 1 and the sheet processing device 50. In FIG. 4, the printing apparatus 1 includes a control board 59 including a central processing unit (CPU) 161, a power source 60, and an operation unit 65. The sheet processing device 50 includes a control board 58 including a CPU 162 and the like, a sheet detection sensor 54, a stapler position detection sensor 165, a stapler motor 163, a stapler moving motor 164, and the like.

The CPU 161 of the printing apparatus 1 controls the each component of the printing apparatus 1. The CPU 161 functions in the following manner when the sheet S inserted to the sheet insertion port 53 is detected in a state where the printing apparatus 1 and the sheet processing device 50 are in a power saving mode. More specifically, the printing apparatus 1 is maintained to be in the power saving mode and the sheet processing device 50 is recovered from the power saving mode. The power source 60 includes a non-all night power source 61, an all-night power source 62, a relay A63, and a relay B64. The non-all night power source 61 is connected to the control board 58 via the relay A63 and is connected to the control board 59 via the relay B64. The all night power source 62 is connected to the CPU 161 of the control board 59 and a sensor interface (IF) circuit 71 of the control board 58.

The non-all night power source 61 is a power source that can supply power or cut off power under control of the CPU 161. The all night power source 62 is a power source that constantly supplies power while a power source plug is inserted in a power source socket. A main power source switch (SW) 67 is operated to turn ON or OFF the power source 60 of the printing apparatus 1. The operation unit 65 is a user interface (display unit, reception unit) used for performing various settings to the printing apparatus 1 and the sheet processing device 50. The operation unit 65 includes power saving mode SW 66 that is operated to make the printing apparatus 1 transition to the power saving mode or recover from the power saving mode.

The CPU 162 of the sheet processing device 50 is connected to the CPU 161 of the printing apparatus 1, and can communicate with the CPU 161 of the printing apparatus 1 to detect an attachment state of each other. The CPU 162 reads a control program stored in a read only memory (ROM) 171 to perform control related to the sheet processing. A random access memory (RAM) 172 is used as a temporary storage area to serve as a main memory, a work area, and the like for the CPU 162. In the sheet processing device 50, a single CPU 162 executes each processing in a flowchart described below by using a single memory (RAM 172) in the present exemplary embodiment. However, other configurations may be employed. For example, each processing may be executed through cooperation between a plurality of CPUs and a plurality RAMs, hard disk drives (HDDs), or a solid state drives (SSDs). Furthermore, the processing may be partially executed by using a hardware circuit such as an application specific integrated circuit (ASIC) as described below. Although not illustrated in FIG. 4, the printing apparatus 1 also includes a RAM, a ROM, an HDD, and the like.

The execution button 55, a sensor IF circuit 71, a sensor IF circuit 72, a sensor IF circuit 73, a motor driving circuit 74, a motor driving circuit 75, and a motor driving circuit 76 are connected to the CPU 162 of the sheet processing device 50. The CPU 162 controls the components of the sheet processing device 50 through the circuits described above. The CPU 162 performs control so that the stapler 51 moves to the position M when the sheet processing device 50 transitions to the power saving mode.

The sheet detection sensor 56 detects the sheet S at the sheet alignment unit 57 and notifies the CPU 162 of the detection result through the sensor IF circuit 72. The sheet detection sensor 54 detects the sheet S at the sheet insertion port 53 and notifies the CPU 162 of the detection result through the sensor IF circuit 71. The stapler position detection sensor 165 is disposed at a position facing the movement path 101 of the stapler 51 (see FIG. 3), and detects the position of the stapler 51. The stapler position detection sensor 165 notifies the CPU 162 of the detection result through the sensor IF circuit 73.

The stapler motor 163 is disposed in the stapler 51, and is driven by the motor driving circuit 75 to drive the stapler 51. Thus, the stapling processing is executed on the sheet S with the stapler 51. The stapler moving motor 164 is driven by the motor driving circuit 74 to move the stapler 51 to the desired position as described above. The position of the stapler 51 is controlled by the CPU 162 based on the detection result from the stapler position detection sensor 165.

The stapler motor 166 is disposed within the stapler 52, and is driven by the motor driving circuit 76 to drive the stapler 52. Thus, the stapleless stapling processing is executed on the sheets S with the stapler 52. The execution button 55 is operated by the user who issues an instruction to execute the stapling processing with the stapler 51. When the user presses the execution button 55, a corresponding signal is transmitted to the CPU 162. The light emitting unit (LED) provided in the execution button 55, is controlled by the CPU 162 to light up or blink.

Figures 5, 5A:
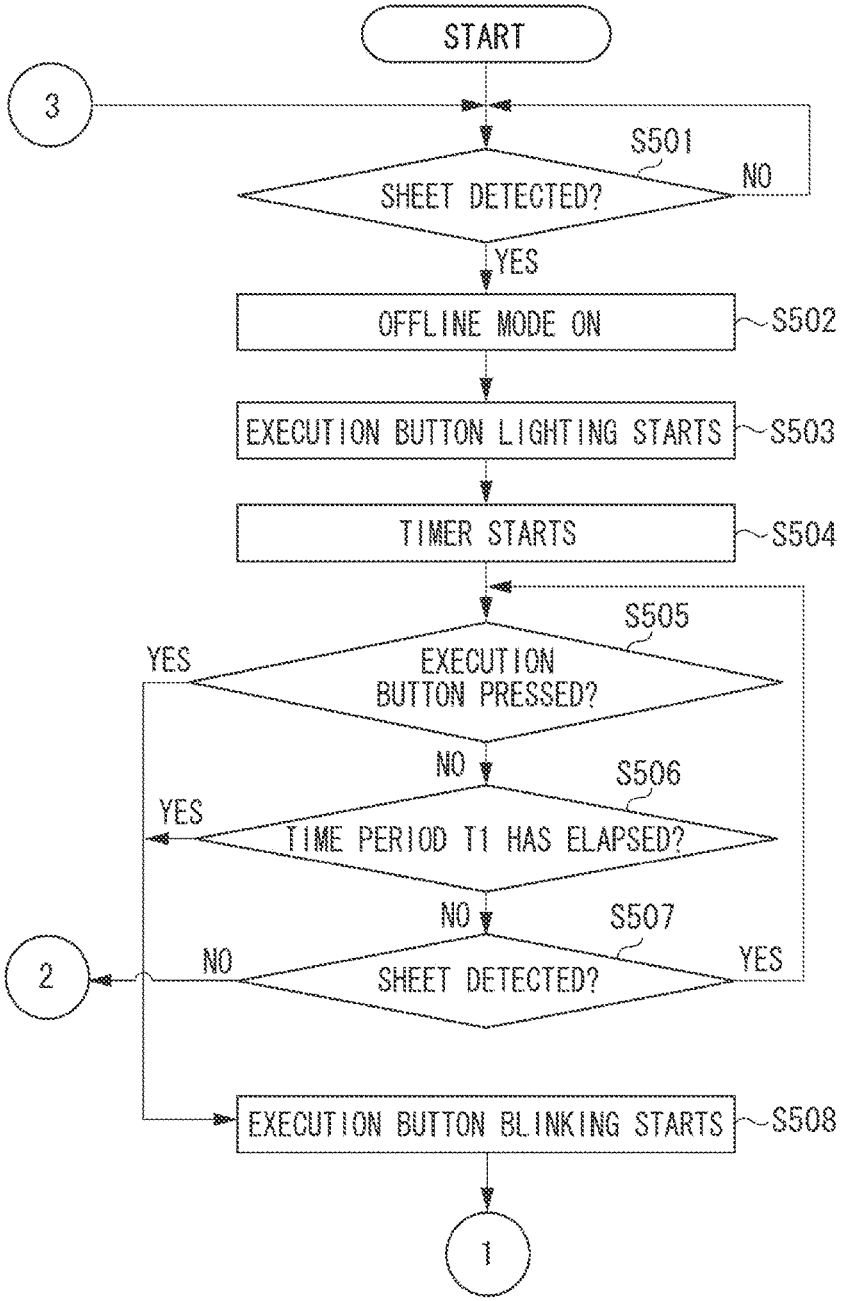
FIG. 5 (including FIG. 5A and FIG. 5B) is a flowchart illustrating processing executed by the sheet processing device according to the first exemplary embodiment of the present invention.
Figure 5B:
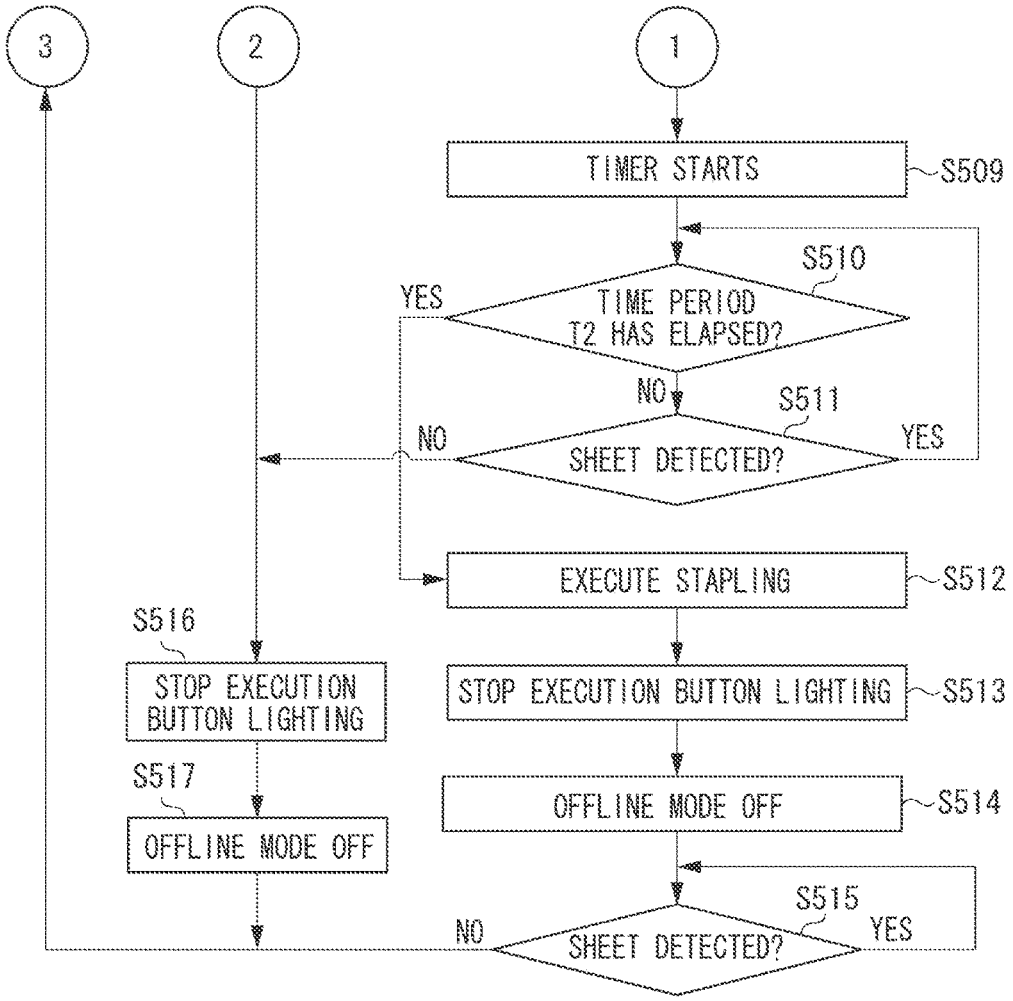

FIG. 5 (including FIG. 5A and FIG. 5B) is a flowchart illustrating processing executed by the sheet processing device 50 when the stapling processing is executed on the sheets S with the offline staple function. Each processing (step) in the flowchart illustrated in FIG. 5 is implemented when the CPU 162 of the sheet processing device 50 executes the control program stored in the ROM 171.

In step S501, the CPU 162 determines whether the sheet detection sensor 54 has detected the sheet S. When the CPU 162 determines that the sheet detection sensor 54 has detected the sheet S (Yes in step S501), the processing proceeds to step S502. On the other hand, when it is determined that the sheet detection sensor 54 has not detected the sheet S (No in step S501), the CPU 162 waits until it is determined that the sheet S has been detected by the sheet detection sensor 54.

In step S502, the CPU 162 turns ON the offline mode. When the offline mode is ON, the printing by the printing apparatus 1 is restricted. In step S503, the CPU 162 starts lighting-up the LED of the execution button 55 so that the user can recognize that the execution button 55 can be pressed (the instruction to execute the sheet processing can be issued). Before the processing in step S503 is executed, the pressing of the execution button 55 is not detected and thus the stapling processing is not executed even when the execution button 55 is pressed. In step S504, the CPU 162 starts a timer provided in the sheet processing device 50.

In step S505, the CPU 162 determines whether the execution button 55 is pressed. When the CPU 162 determines that the execution button 55 is pressed (Yes in step S505), the processing proceeds to step S508. On the other hand, when the CPU 162 determines that the execution button 55 is not pressed (No in step S505), the processing proceeds to step S506. In step S506, the CPU 162 determines whether an elapsed time period, measured by the timer started at step S504, has reached a predetermined time period T1. When the CPU 162 determines that the elapsed time period has reached the predetermined time period T1 (Yes in step S506), the processing proceeds to step S508. On the other hand, when the CPU 162 determines that the elapsed time period has not reached the predetermined time period T1 (No in step S506), the processing proceeds to step S507. The predetermined time period T1 is three seconds in the present exemplary embodiment but may be another length of time or may be variably set by the user. In step S507, the CPU 162 determines whether the sheet detection sensor 54 has detected the sheet S. When the CPU 162 determines that the sheet S is detected by the sheet detection sensor 54 (Yes in step S507), the processing returns to step S505. On the other hand, when the CPU 162 determines that the sheet S is not detected by the sheet detection sensor 54 (No in step S507), the processing proceeds to step S516.

When the processing proceeds from step S505 to step S508, the sheet processing is (manually) executed in response to a user operation. On the other hand, when the processing proceeds from step S506 to step S508, the sheet processing is (automatically) executed according to elapse of the predetermined time period. The processing proceeds from step S507 to step S516 when, for example, the user who has once set the sheet S might have changed his or her mind and pulled out the sheet S.

In step S508, the CPU 162 starts the blinking of the LED of the execution button 55 so that the user can recognize that the sheet processing is soon executed. In step S509, the CPU 162 starts a timer provided in the sheet processing device 50. The timer may be the same as or different from the timer started at step S504. In the case of using the same timer, the processing of resetting the timer is required when the processing proceeds from step S508 to step S509.

In step S510, the CPU 162 determines whether an elapsed time period measured by the timer started at step S509, has reached a predetermined time period T2. When the CPU 162 determines that the elapsed time period has reached the predetermined time period T2 (Yes in step S509), the processing proceeds to step S512. On the other hand, when the CPU 162 determines that the elapsed time period has not reached the predetermined time period T2 (No in step S509), the processing proceeds to step S511. The predetermined time period T2 is one second in the present exemplary embodiment but may be another length of time or may be variably set by the user.

In step S511, the CPU 162 determines whether the sheet S is detected by the sheet detection sensor 54. When the CPU 162 determines that the sheet S is detected by the sheet detection sensor 54 (Yes in step S511), the processing returns to step S510. On the other hand, when the CPU 162 determines that the sheet S is not detected by the sheet detection sensor 54 (No in step S511), the processing proceeds to step S516. The processing proceeds from S511 to step S516 when the predetermined time period T1 has elapsed after the user has set the sheet S, or, for example, the user who has pressed the execution button 55 might have changed his or her mind and pulled out the sheet S so that the stapling processing is not executed.

In step S512, the CPU 162 causes the stapler 51 to execute the stapling processing on a plurality of the sheets S that has been set to the sheet processing device 50 (inserted to the sheet insertion port 53). In step S513, the CPU 162 stops the lighting-up of the LED of the execution button 55. In step S514, the CPU 162 turns OFF the offline mode to cancel the printing restriction.

In step S515, the CPU 162 determines whether the sheet S is detected by the sheet detection sensor 54. When the CPU 162 determines that the sheet S is not detected by the sheet detection sensor 54 (No in step S515), the processing returns to step S501. On the other hand, when the CPU 162 determines that the sheet S is detected by the sheet detection sensor 54 (Yes in step S515), the CPU 162 waits until the sheet S is no longer detected. The processing returns to step S501 when the sheet S is no longer detected. This is because when the sheets S remain set after the stapling processing has been executed, the stapling processing needs to be prevented from being executed again on the same position of the same sheets S. In step S516, the CPU 162 stops the lighting of the LED of the execution button 55. In step S517, the CPU 162 turns OFF the offline mode to cancel the printing restriction, and the processing returns to step S501.

As described above, in the first exemplary embodiment, the control for executing the stapling processing in response to the pressing of the execution button 55, and the control for executing the stapling processing according to the elapse of the predetermined time period T1, can be executed after the sheet detection sensor 54 detects the sheet S. More specifically, the stapling processing is executed after the same notification (the blinking of the LED of the execution button 55) is made to the user both in the case where the execution button 55 has been pressed and in the case where the predetermined time period T1 has elapsed. Thus, the notification indicating the execution of the stapling is made in an easily recognizable manner in the case where the sheet processing is executed in response to the reception of the execution instruction, and in the case where the sheet processing is executed according to the elapse of the predetermined time period.

Next, a second exemplary embodiment of the present invention will be described. In the second exemplary embodiment, an example is described that additionally includes a configuration in which the execution of the stapling processing is cancelled when the execution button 55 is operated again while the LED of the execution button 55 is blinking. Only the points different from the first exemplary embodiment will be described below, and the other points are similar to the first exemplary embodiment.

Figure 6A:
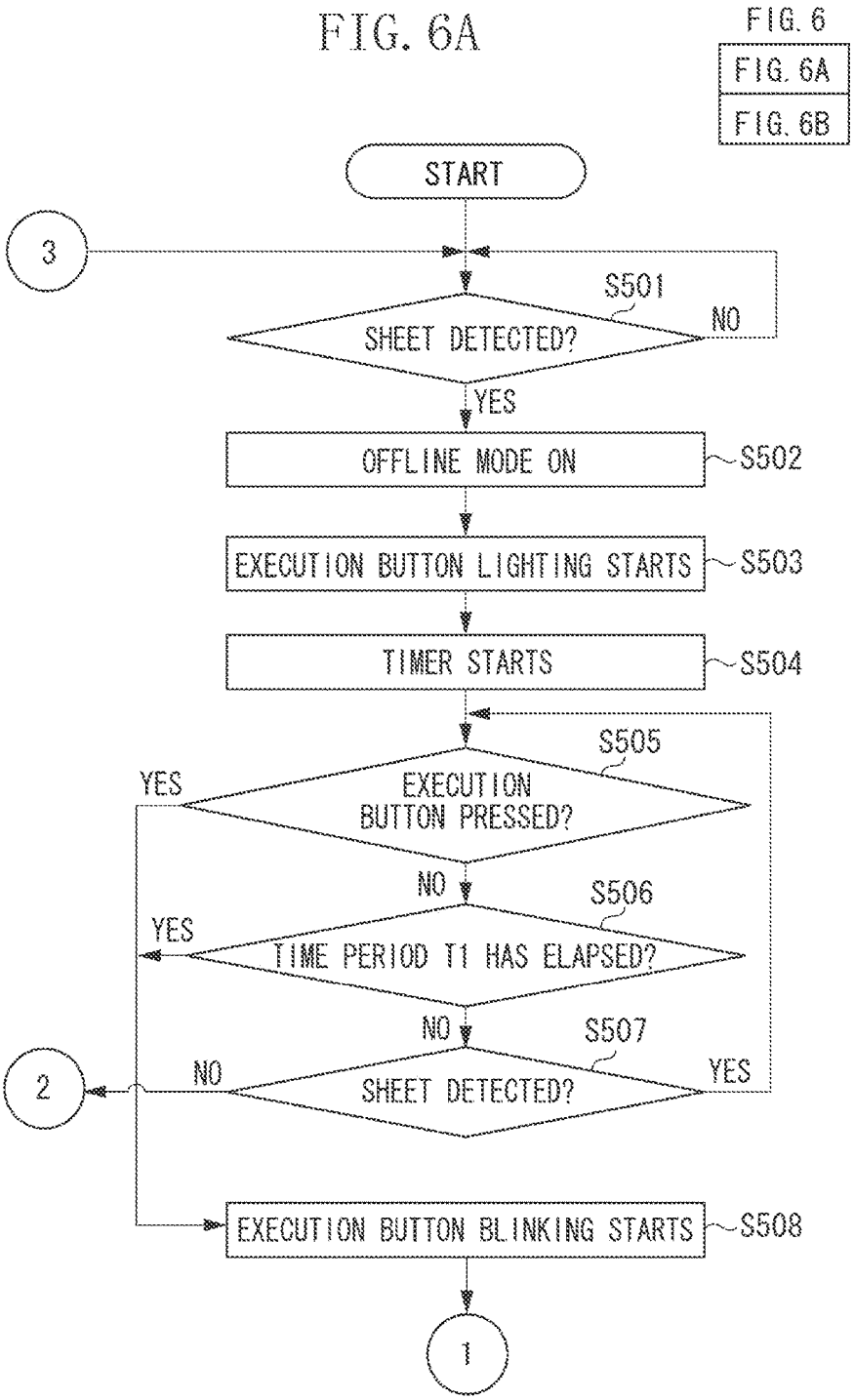
FIG. 6 (including FIG. 6A and FIG. 6B) is a flowchart illustrating processing executed by the sheet processing device according to a second exemplary embodiment of the present invention.
Figure 6B:
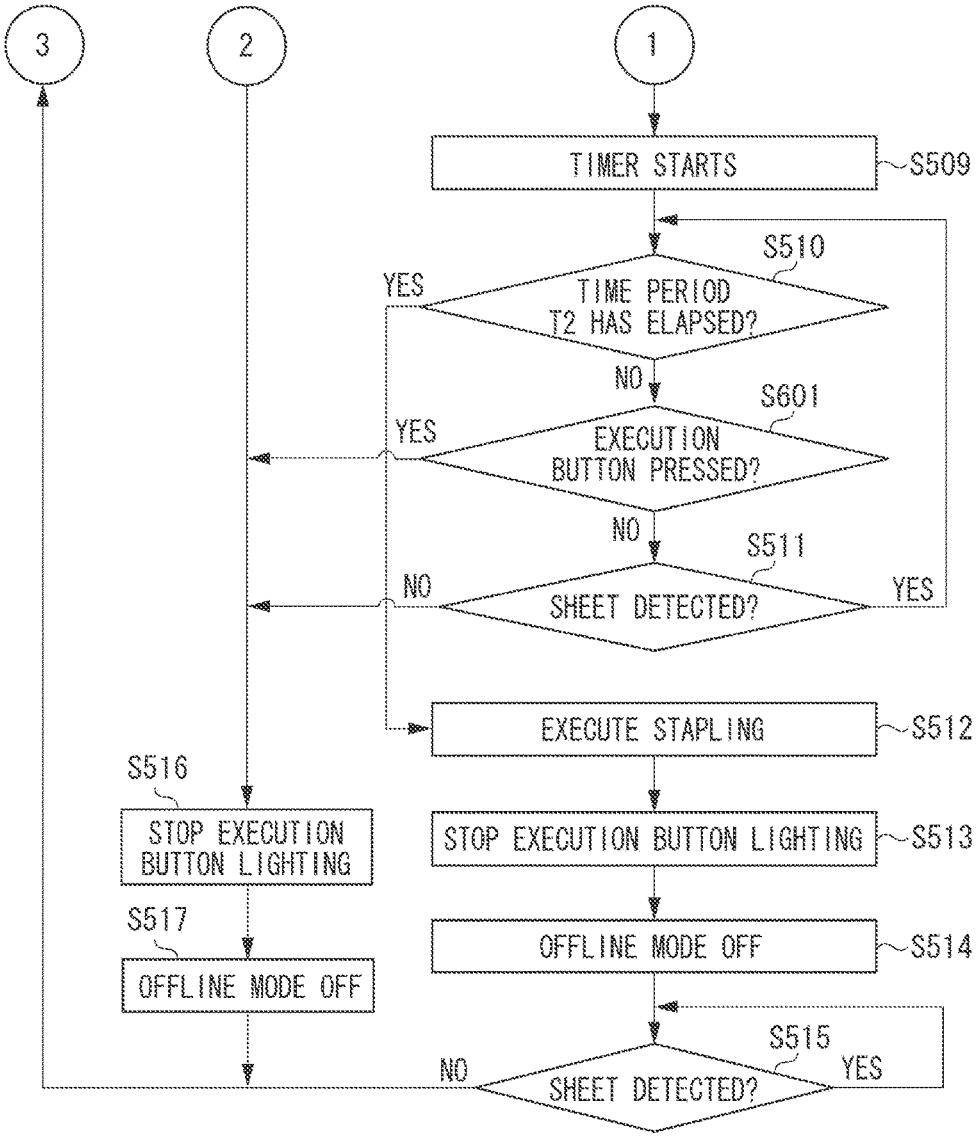

FIG. 6 (including FIG. 6A and FIG. 6B) is a flowchart illustrating processing executed by the sheet processing device 50 when the stapling processing is performed on the sheets S with the offline staple function, and corresponds to the flowchart illustrated in FIG. 5 described in the first exemplary embodiment. The flowchart in FIG. 6 is different from the flowchart in FIG. 5 in that step S601 is added. Steps S501 to S509 and S512 to S517 are the same as those described in the first exemplary embodiment and thus will not be described.

In step S510, the CPU 162 determines whether the elapsed time measured by the timer started at step S509, has reached the predetermined time period T2. When the CPU 162 determines that the elapsed time has reached the predetermined time period T2 (Yes in step S510), the processing proceeds to step S512. On the other hand, when the CPU 162 determines that the elapsed time has not reached the predetermined time period T2 (No in step S510), the processing proceeds to step S601. The predetermined time period T2 is one second in the present exemplary embodiment but may be another length of time or may be variably set by the user.

In step S601, the CPU 162 determines whether the execution button 55 has been pressed. When the CPU 162 determines that the execution button 55 has been pressed (Yes in step S601), the processing proceeds to step S516. On the other hand, when the CPU 162 determines that the execution button 55 has not been pressed (No in step S601), the processing proceeds to step S511. The execution button 55 is pressed at this timing in the following two patterns. A first pattern corresponds to a case where the processing has proceeded from step S505 to step S508. In this case, the user who has operated the execution button 55 operates the execution button 55 again. A second pattern corresponds to a case where the processing proceeds from step S506 to step S508. In this case, the user operates the execution button 55 after the predetermined time period T1 has elapsed.

In any of the two patterns, the blinking of the execution button 55 starts in step S508, and the user who has recognized that the stapling processing will be soon executed, according to the blinking, presses the execution button 55 to cancel the execution of the stapling processing. When the processing proceeds from step S601 to step S516, the CPU 162 stops the lighting of the execution button 55 without executing the stapling processing, and the offline mode is turned OFF.

As described above, in the second exemplary embodiment, the user who has recognized that the stapling processing will be soon executed from the blinking of the execution button 55 can easily cancel the execution of the stapling processing by pressing the execution button 55.

Other Embodiments

In the first and the second exemplary embodiments, only the stapling processing with the stapler 51 using the staple is described as a subject of the offline staple function. Alternatively, the present invention may be applied to the stapleless stapling processing with the stapler 52 using no staple. The present invention may also be applied to punch processing with a puncher (not illustrated). In the first and the second exemplary embodiments, the sheet processing device 50 connected to the printing apparatus 1 is described, as an example. However, the present invention may be applied to the sheet processing device 50 that is not connected to the printing apparatus 1.

In the first and the second exemplary embodiments described above, an example is described where the same notification is made in the manual execution and the automatic execution. Alternatively, for example, the blinking speed may be altered between the manual execution and the automatic execution.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-263176, filed Dec. 25, 2014, which is hereby incorporated by reference herein in its entirety.

What is claimed is:

1. A sheet processing device comprising:

a stapler configured to execute binding processing for a sheet;

a sheet detection sensor configured to detect the sheet inserted into the stapler;

an execution key which is pressed by a user for executing the binding processing;

a light emitting unit provided on the execution key; and a controller configured to control the stapler to execute the binding processing in response to a signal from the execution key in a case where the execution key is pressed by the user before a predetermined time elapses after detection of the sheet and control the stapler to execute the binding processing upon an elapse of the predetermined time in a case where the predetermined time has elapsed without pressing of the execution key by the user after detection of the sheet, wherein the controller controls the light emitting unit to emit light in a first light emitting state in response to the detection of the sheet by the sheet detection sensor and, in the case where the predetermined time has elapsed without the pressing of the execution key by the user after the detection of the sheet by the sheet detection sensor, controls the light emitting unit to emit light in a second light emitting state that is different from the first light emitting state before execution of the binding processing.

2. The sheet processing device according to claim 1, wherein the first light emitting state is a state of lighting-up of the light emitting unit, and the second light emitting state is a state of blinking of the light emitting unit.

3. The sheet processing device according to claim 1, wherein the controller is configured to cancel execution of the binding processing by the stapler when the sheet detection sensor no longer detects the sheet while the light emitting unit is in the second light emitting state.

4. The sheet processing device according to claim 1, wherein the sheet processing device is connected to a printing apparatus, and is capable of executing binding processing involving printing and binding processing not involving the printing.

5. A sheet processing device comprising:

a stapler configured to execute binding processing for a sheet;

a sheet detection sensor configured to detect the sheet inserted into the stapler;

an execution key which is pressed by a user for executing the binding processing; and a controller configured to control the stapler to execute the binding processing in response to a signal from the execution key in a case where the execution key is pressed by the user before a predetermined time elapses after detection of the sheet and control the stapler to execute the binding processing upon an elapse of the predetermined time in a case where the predetermined time has elapsed without pressing of the execution key by the user after detection of the sheet, wherein the controller performs control for making a first notification in response to the detection of the sheet by the sheet detection sensor and, in the case where the predetermined time has elapsed without the pressing of the execution key by the user after the detection of the sheet, performs control for making a second notification before execution of the binding processing.

6. The sheet processing device according to claim 5 further comprising a light emitting unit having a first emitting state and a second emitting state, wherein the first light emitting state is a state of lighting-up of the light emitting unit, and the second light emitting state is a state of blinking of the light emitting unit.

7. The sheet processing device according to claim 5 further comprising a light emitting unit having a first emitting state and a second emitting state, wherein the controller is configured to cancel execution of the binding processing by the stapler when the sheet detection sensor no longer detects the sheet while the light emitting unit is in the second light emitting state.

8. The sheet processing device according to claim 5, wherein the sheet processing device is connected to a printing apparatus, and is capable of executing binding processing involving printing and binding processing not involving the printing.

9. A sheet processing device comprising:

a stapler configured to execute binding processing for a sheet;

a sheet detection sensor configured to detect the sheet inserted into the stapler;

an execution key which is pressed by a user for executing the binding processing;

a light emitting unit provided on the execution key; and a controller configured to control the stapler to execute the binding processing in response to a signal from the execution key in a case where the execution key is pressed by the user before a predetermined time elapses after detection of the sheet and cause the stapler to execute the binding processing upon an elapse of the predetermined time in a case where the predetermined time has elapsed without pressing of the execution key by the user after detection of the sheet, wherein the controller starts lighting-up of the light emitting unit in response to the detection of the sheet by the sheet detection sensor and, in the case where the predetermined time has elapsed without the pressing of the execution key by the user after the detection of the sheet, controls the light emitting unit to blink before execution of the binding processing.

10. The sheet processing device according to claim 9, wherein the light emitting unit has a first emitting state and a second emitting state, and the first light emitting state is a state of lighting-up of the light emitting unit, and the second light emitting state is a state of blinking of the light emitting unit.

11. The sheet processing device according to claim 9, wherein the light emitting unit has a first emitting state and a second emitting state, and wherein the controller is configured to cancel execution of the binding processing by the stapler when the sheet detection sensor no longer detects the sheet while the light emitting unit is in the second light emitting state.

12. The sheet processing device according to claim 9, wherein the sheet processing device is connected to a printing apparatus, and is capable of executing binding processing involving printing and binding processing not involving the printing.

* * * * *